US009194564B2

(12) United States Patent
Liu et al.

(10) Patent No.: US 9,194,564 B2
(45) Date of Patent: Nov. 24, 2015

(54) REFLECTOR HOLDER FOR CHRISTMAS LAMP

(71) Applicant: Chun-Ming Liu, Hsinchu (TW)

(72) Inventors: Chun-Ming Liu, Hsinchu (TW); Uei-Shin Chen, Hsinchu (TW)

(73) Assignee: Chun-Ming Liu, Hsinchu (TW)

( * ) Notice: Subject to any disclaimer, the term of this patent is extended or adjusted under 35 U.S.C. 154(b) by 178 days.

(21) Appl. No.: 14/163,127

(22) Filed: Jan. 24, 2014

(65) Prior Publication Data

US 2015/0211717 A1 Jul. 30, 2015

(51) Int. Cl.

| | |
|---|---|
| ***F21V 17/04*** | (2006.01) |
| ***F21V 17/06*** | (2006.01) |
| ***F21V 17/14*** | (2006.01) |
| ***F21V 7/00*** | (2006.01) |
| ***F21V 21/088*** | (2006.01) |
| *F21W 121/04* | (2006.01) |

(52) U.S. Cl.

CPC ..... *F21V 17/04* (2013.01); *F21V 7/0066* (2013.01); *F21V 17/14* (2013.01); *F21V 21/088* (2013.01); *F21W 2121/04* (2013.01)

(58) Field of Classification Search

CPC ..... F21V 7/04; F21V 17/14; F21V 17/18; F21V 7/0066

USPC ..... 362/652–654

See application file for complete search history.

(56) References Cited

U.S. PATENT DOCUMENTS

| | | | | |
|---|---|---|---|---|
| 5,435,741 | A * | 7/1995 | Wang | F21S 4/001 439/314 |
| 7,306,360 | B2 * | 12/2007 | Lin | F21V 3/00 362/267 |
| 2012/0257396 | A1 * | 10/2012 | Chiu | F21V 3/02 362/363 |
| 2013/0088854 | A1 * | 4/2013 | Chiu | F21V 19/0025 362/95 |

* cited by examiner

*Primary Examiner* — Karabi Guharay

(74) *Attorney, Agent, or Firm* — Rabin & Berdo, P.C.

(57) ABSTRACT

A Christmas light includes a reflector holder defining an axis, a lamp body and a reflector. The reflector holder has an axial hole, an axial engagement slot and a radial slot in spatial communication with the axial engagement slot. The lamp body includes a light emitter and a tenon formed at one side thereof. The lamp body extends through the axial hole in the reflector holder with the tenon sliding into the axial engagement slot and finally engaged in the radial slot once the reflector holder is rotated relative to the lamp body. The reflector has a bottom opening for mounting onto the reflector holder from above, thereby enclosing the light emitter within the reflector.

5 Claims, 7 Drawing Sheets

REFLECTOR HOLDER FOR CHRISTMAS LAMP

BACKGROUND OF THE INVENTION

1. Field of the Invention

The present invention relates generally to a Christmas light, more particularly to a Christmas light that is adapted to be assembled in a quick manner and that is adapted to be detached easily.

2. The Prior Arts

Christmas lights are major decorations during the Christmas season. A plurality of Christmas lights are coupled together via wiring and are mounted on a Christmas trees, building or bushes so as to provide aesthetic or fascinating effects.

There are two way to judge whether the market price of a Christmas light. For the manufacturers, it is to simplify the structure of the Christmas light so as to swiftly produce and assemble the same in the factory, thereby achieving the high yield and thus lowering the manufacturing cost thereof.

As for the consumers, the reflector holder, the reflector and the lamp body constituting the Christmas light is replaceable is a major concern so as to prolong its usage and economizing the expense.

FIG. 7 shows a conventional Christmas light that includes a light body A and a reflector B. A light body A consists of a lamp holder C at lower portion thereof, an integrally formed reflector holder E at the upper portion and a light emitting element D (generally Light Emitting Diode) mounted within the reflector holder E. The reflector holder E has an inner peripheral wall formed with an inwardly and radially projecting annular flange A1. The reflector B has a lower cylindrical portion formed with annular engagement groove B1. For assembly, the lower cylindrical portion of the reflector B is inserted into the integrally formed reflector holder E and is rotated relative to each other so as to engage the annular flange A1 in the engagement groove B1, thereby resulting in the conventional Christmas light.

It seems like that assembling of the conventional Christmas light is easy and thus it is convenient the consumer to handle it. However, during the mass production, no high yield effect can be obtained owing to integrally formation of the lamp holder C and the reflector holder E, which, in turn, cannot reduce the manufacturing cost thereof. Further, the consumer cannot replace the reflector B in DIY style relative to the accordingly reflector holder E.

SUMMARY OF THE INVENTION

A primary object of the present invention is to provide a Christmas light that is adapted to be assembled or detached in a quick manner and that is adapted to be produced in a more simple way.

A Christmas light according to the present invention includes a reflector holder defining an axis, a lamp body and a reflector. The reflector holder has an axial hole, an axial engagement slot and a radial slot in spatial communication with the axial engagement slot. The lamp body includes a light emitter and a tenon formed lamp holder. The lamp body extends through the axial hole in the reflector holder with the tenon sliding into the axial engagement slot and finally engaged in the radial slot once the reflector holder is rotated relative to the lamp body. The reflector has a bottom opening for mounting onto the reflector holder from above, thereby enclosing the light emitter within the reflector.

Preferably, the reflector holder includes a disk portion and a tubular portion coaxially extending downwardly from and cooperating with the disk portion to define the axial hole therethrough. The reflector holder further includes a protrusion extending outwardly and radially from the tubular portion. The protrusion has an inner wall formed the axial engagement slot. The tubular portion is formed with the radial slot in spatial communication with the axial engagement slot. The tubular portion further has a limiting stub formed within the radial slot such that the radial slot has a width smaller than a height of the tenon at the limiting stub.

For assembly, the lamp body is inserted into the axial hole in the reflector holder, where the tenon slides into the axial engagement slot and finally engages in the radial slot once the reflector holder is rotated relative to the lamp body.

The reflector has a bottom opening for mounting onto the reflector holder from above, thereby enclosing the light emitter within the reflector.

Preferably, the disk portion of the reflector holder has an upper inner peripheral wall formed with an annular flange projecting inwardly and radially from the inner peripheral wall. The reflector includes a low cylindrical portion that defines the bottom opening and that is formed with an annular groove at outer peripheral wall for engaging the annular flange of the reflector holder, when the reflector and the reflector holder attaches relative to each other.

In another embodiment of the present invention, the disk portion of the reflector holder has an upper inner peripheral wall formed with inner threads. The reflector includes a low cylindrical portion that defines the bottom opening and that is formed with external threads at outer peripheral wall for engaging the inner threads of the reflector holder when the reflector and the reflector holder rotates relative to each other.

Preferably, the reflector holder further includes a flexible clip integrally formed at one side of the tubular portion for clamping Christmas ornament thereon.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
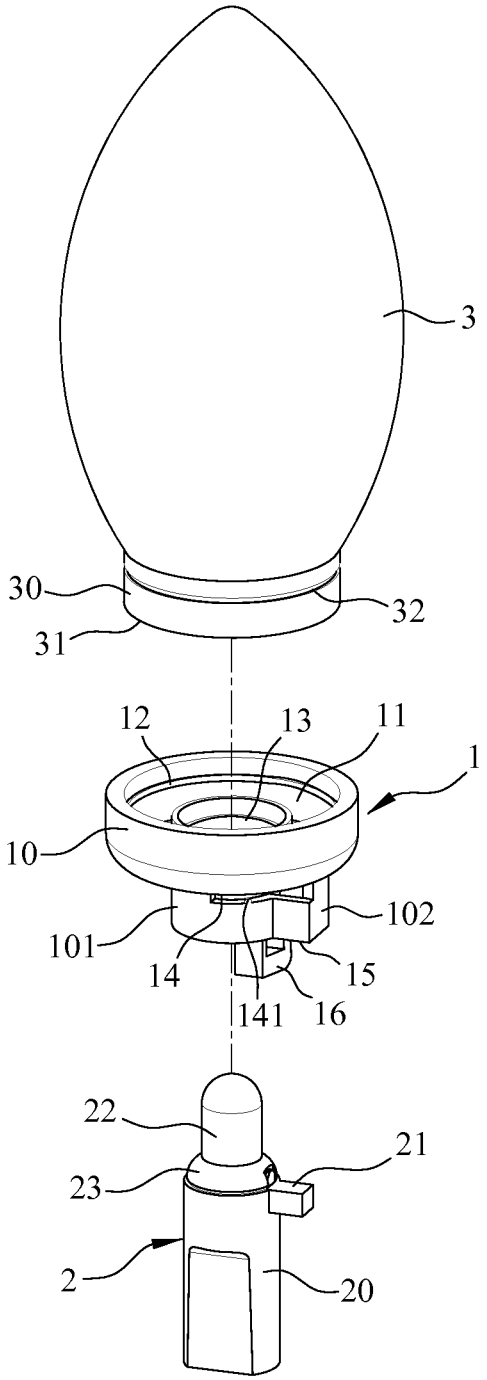
FIG. 1 is an exploded view of a Christmas light of the present invention.
Figure 2:
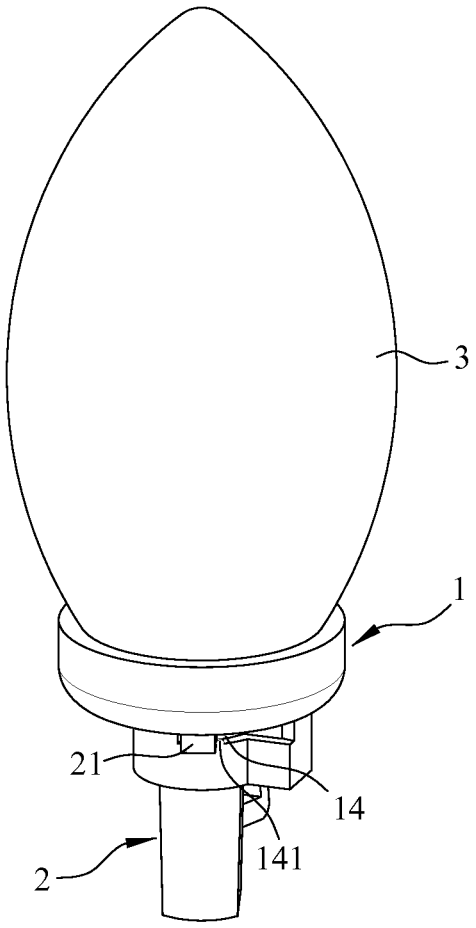
FIG. 2 is a perspective view of the Christmas light of the present invention.
Figure 3:
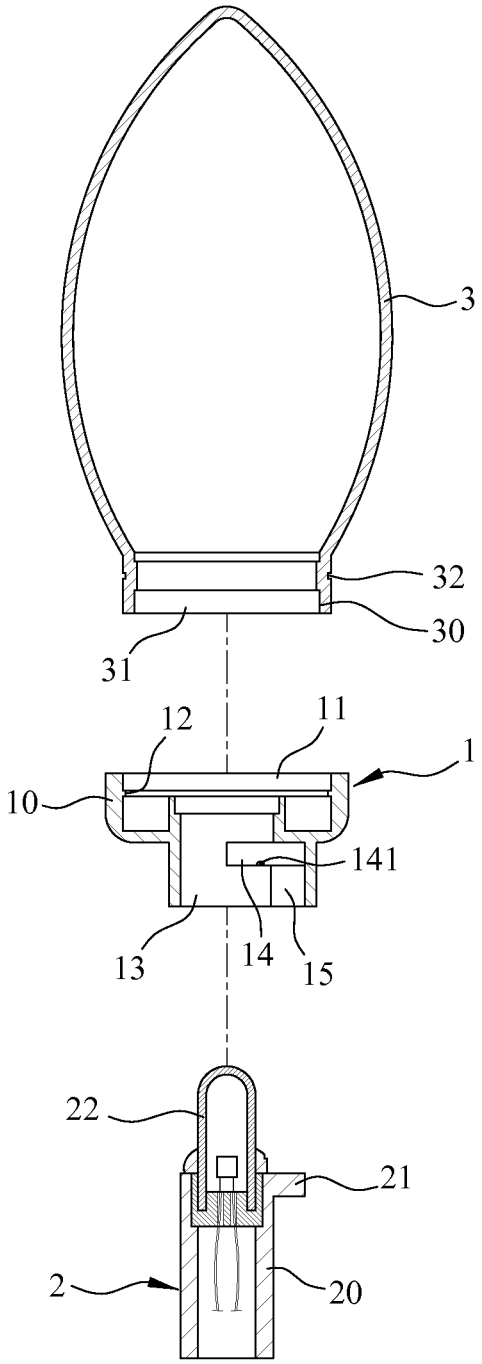
FIG. 3 is a cross-sectional view of exploded Christmas light of the present invention.
Figure 4:
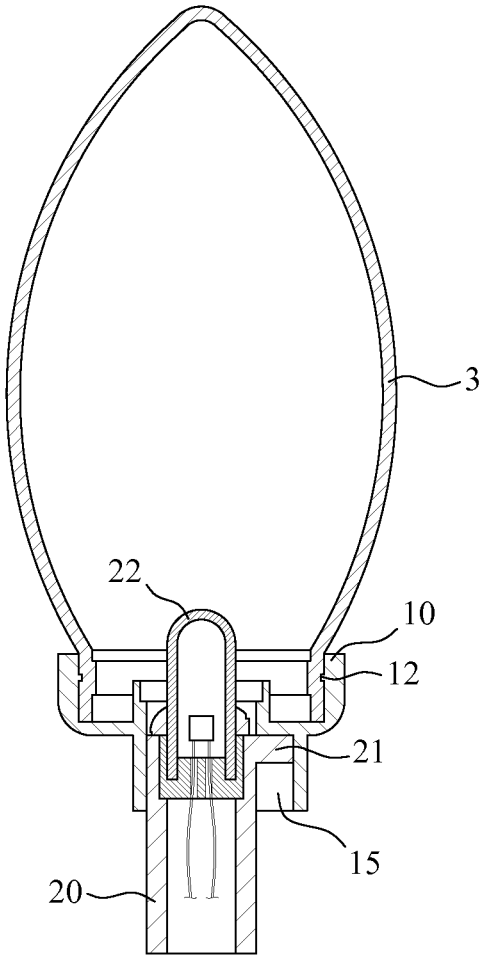
FIG. 4 is a cross-sectional and perspective view of the Christmas light of the present invention.

Referring to FIGS. 1-3, wherein FIG. 1 is an exploded view of a Christmas light of the present invention; FIG. 2 is a perspective view of the Christmas light of the present invention; and FIG. 3 is a cross-sectional view of exploded Christmas light of the present invention. As illustrated, the Christmas light of the present includes a reflector holder 1, a lamp body 2 and a reflector 3, each of which is independently and separately formed. The reflector holder 1 is preferably made from plastic material by injection technique, defines an axis, includes a disk portion 10 and a tubular portion 101 coaxially extending downwardly from and cooperating with the disk portion 10 to define an axial hole 13 therethrough. The reflector holder 1 further includes a rectangular protrusion 102 extending outwardly and radially from the tubular portion 101. The protrusion 102 has an inner wall formed an axial engagement slot 15. The tubular portion 101 is formed with a radial slot 14 in spatial communication with the axial engagement slot 15. Preferably, the tubular portion 101 is further has a limiting stub 141 formed within the radial slot 14 such that the radial slot 14 has a width smaller than a height of the tenon at the limiting stub 141. The function of the limiting stub 141 will be explained in the following paragraphs. In this embodiment, the disk portion 10 of the reflector holder 1 has an upper inner peripheral wall 11 formed with an annular flange 12 projecting inwardly and radially from the inner peripheral wall 11. Note that the inner peripheral wall 11 should have a diameter greater than that of the axial hole 13 and a sufficient depth to accommodate a lower portion of the reflector 3. The reflector holder 1 further includes a flexible clip 16 integrally formed at one side of the tubular portion 101 for clamping a Christmas ornament, like Christmas trees.

Figure 5A:
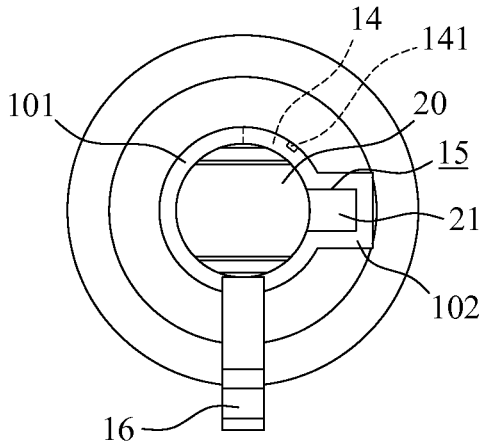
FIG. 5A is a planar cross-sectional view illustrating a condition when a reflector holder is inserted into a reflector in the Christmas light of the present invention.
Figure 5B:
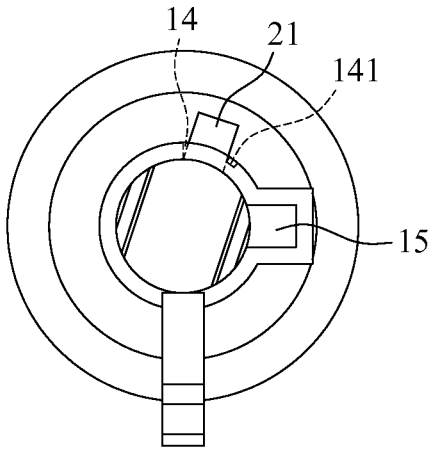
FIG. 5B is a planar cross-sectional view illustrating a condition prior to the reflector holder is rotated relative to the reflector in the Christmas light of the present invention.

The lamp body 2 includes a lamp holder 20, which is installed with a light emitter 22 via a lamp base 23 at an upper end, and a rectangular tenon 21 formed at one side of the lamp holder 20. In this embodiment, an LED (Light Emitting Diode) serves as the light emitter 22 for saving energy and since it provides a longer service lift. Note that the lamp base 23 has an outer diameter slightly smaller than the inner diameter of the axial hole 13 to permit extension of the lamp body 2 into the axial hole 13. The tenon 21 has a dimension complimenting with the width of the axial slot 15 and the radial slot 14. When the lamp body 2 is inserted through the axial hole 13 in the reflector holder 1, the tenon 21 slides into the axial engagement slot 15 and finally engages in the radial slot 14 once the reflector holder 1 is rotated relative to the lamp body 2 (see FIGS. 5A and 5B). Note that at this time, the tenon 21 is retained stably and securely within the radial slot 14 after forcefully passing through the limiting element 141 in the radial slot 14 owing to the radial slot 14 has a width smaller than the height of the tenon 21 at the limiting stub 141. Thus, the lamp body 2 is retained securely in the reflector holder 1 with the light emitting emitter 22 extending into the interior of the reflector holder 1

The reflector 3 may have any shapes or configuration. The reflector 3 has a bottom opening 31 for mounting onto the inner peripheral wall 11 of the disk portion 10 from above, thereby enclosing the light emitter 22 within the reflector 3. In this embodiment, the disk portion 10 of the reflector holder 1 has an annular flange 12 projecting inwardly and radially from the inner peripheral wall 11. The reflector 3 preferably includes a low cylindrical portion 30 that defines the bottom opening 11 and that is formed with an annular groove 32 at outer peripheral wall for engaging the annular flange 12 of the reflector holder 1.

Figure 6:
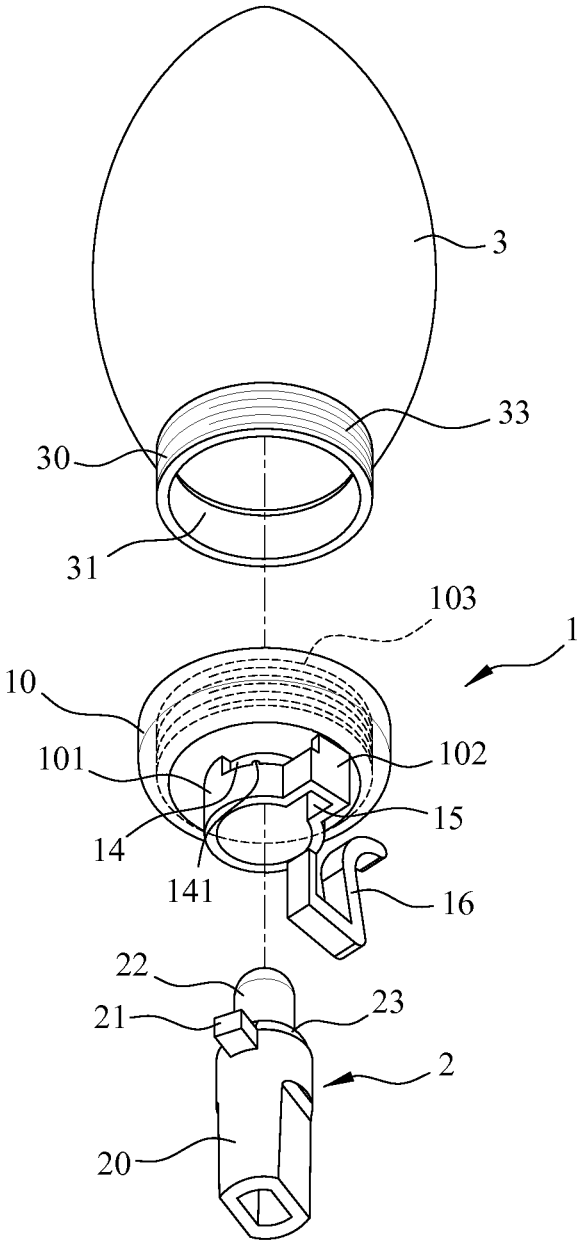
FIG. 6 is an exploded view of another embodiment of the Christmas light of the present invention.
Figure 7:
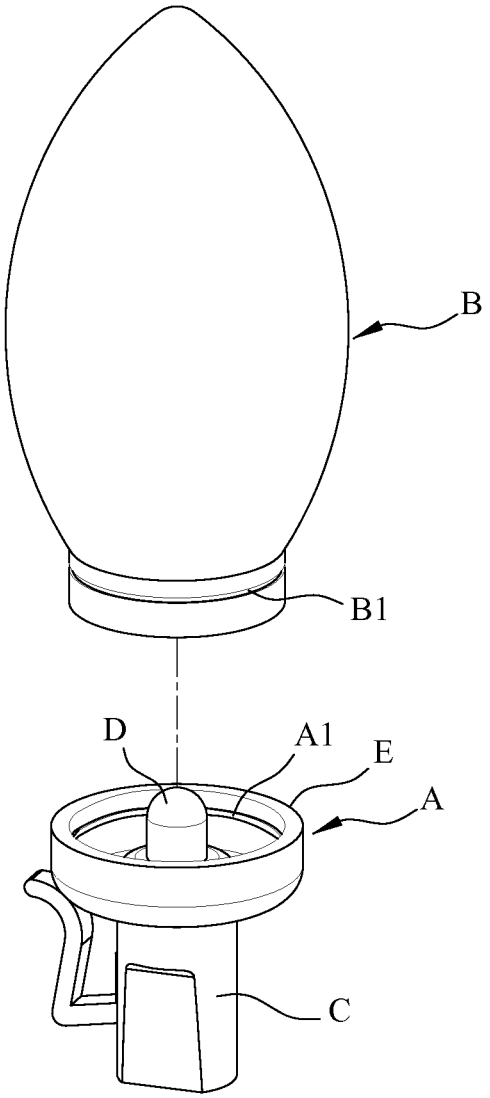
FIG. 7 (PRIOR ART)
FIG. 7 is an exploded view of a Christmas light of the prior art.

FIG. 6 is an exploded view of another embodiment of the Christmas light of the present invention, which has a structure similar to the previous embodiment. Except that the disk portion 10 of the reflector holder 1 has an upper inner peripheral wall formed with inner threads 103. The reflector 3 includes a low cylindrical portion 30 that defines the bottom opening 31 and that is formed with external threads 33 at outer peripheral wall for engaging threadedly the inner threads 103 of the reflector holder 1.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A Christmas light comprising:

a reflector holder defining an axis, including a disk portion and a tubular portion coaxially extending downwardly from and cooperating with said disk portion to define an axial hole therethrough, said reflector holder further including a protrusion extending outwardly and radially from said tubular portion, said protrusion having an inner wall formed an axial engagement slot, said tubular portion being formed with a radial slot in spatial communication with said axial engagement slot;

a lamp body including a light emitter and a tenon formed at one side thereof, said lamp body extending through said axial hole of said reflector holder with said tenon sliding into said axial engagement slot and finally engaged in said radial slot once said reflector holder is rotated relative to said lamp body; and a reflector having a bottom opening for mounting onto said reflector holder from above, thereby enclosing said light emitter within said reflector.

2. The Christmas light according to claim 1, wherein said tubular portion is further has a limiting stub formed within said radial slot such that said radial slot has a width smaller than a height of said tenon at said limiting stub.

3. The Christmas light according to claim 1, wherein said disk portion of said reflector holder has an upper inner peripheral wall formed with an annular flange projecting inwardly and radially from said inner peripheral wall, said reflector including a low cylindrical portion that defines said bottom opening and that is formed with an annular groove at outer peripheral wall for engaging said annular flange of said reflector holder.

4. The Christmas light according to claim 1, wherein said disk portion of said reflector holder has an upper inner peripheral wall formed with inner threads, said reflector including a low cylindrical portion that defines said bottom opening and that is formed with external threads at outer peripheral wall for engaging said inner threads of said reflector holder.

5. The Christmas light according to claim 1, wherein said reflector holder 1 further includes a flexible clip integrally formed at one side of said tubular portion.

* * * * *